US009188001B2

(12) United States Patent
Flenche

(10) Patent No.: US 9,188,001 B2
(45) Date of Patent: Nov. 17, 2015

(54) COMBUSTION ENGINE

(75) Inventor: George Flenche, Elizabeth Downs S.A. (AU)

(73) Assignee: Exodus R&D International PTE, LTD., Singapore (SG)

( * ) Notice: Subject to any disclaimer, the term of this patent is extended or adjusted under 35 U.S.C. 154(b) by 0 days.

(21) Appl. No.: 13/639,630

(22) PCT Filed: Apr. 7, 2011

(86) PCT No.: PCT/AU2011/000398
§ 371 (c)(1),
(2), (4) Date: Oct. 5, 2012

(87) PCT Pub. No.: WO2011/123894
PCT Pub. Date: Oct. 13, 2011

(65) Prior Publication Data

US 2013/0019835 A1 Jan. 24, 2013

(30) Foreign Application Priority Data

Apr. 7, 2010 (AU) ..... 2010901451

(51) Int. Cl.
*F01B 9/02* (2006.01)

(52) U.S. Cl.
CPC ..... *F01B 9/023* (2013.01)

(58) Field of Classification Search
CPC .... F01C 1/3445; F01C 21/0863; F01C 19/12; F01C 1/44; F01C 21/0881; F01B 9/023
USPC ..... 123/197.1, 197.4
See application file for complete search history.

(56) References Cited

U.S. PATENT DOCUMENTS

| | | | | | |
|---|---|---|---|---|---|
| 1,505,856 | A * | 8/1924 | Briggs | F01B 9/023 | 123/197.4 |
| 2,513,514 | A | 7/1950 | Poage | | |
| 4,459,945 | A * | 7/1984 | Chatfield | F01B 9/023 | 123/197.2 |
| 4,485,768 | A * | 12/1984 | Heniges | 123/48 B | |
| 4,791,898 | A * | 12/1988 | Jayne | F01B 9/023 | 123/197.4 |
| 4,803,890 | A * | 2/1989 | Giuliani | F01B 9/023 | 123/197.4 |
| 5,431,130 | A * | 7/1995 | Brackett | F01B 9/023 | 123/190.2 |
| 5,546,897 | A * | 8/1996 | Brackett | F01B 9/023 | 123/197.2 |
| 5,560,327 | A * | 10/1996 | Brackett | 123/55.7 | |
| 6,125,802 | A | 10/2000 | Pen | | |
| 7,328,682 | B2 * | 2/2008 | Fisher | F01B 9/023 | 123/197.4 |
| 2012/0227389 | A1 * | 9/2012 | Hinderks | 60/317 | |

FOREIGN PATENT DOCUMENTS

| | | |
|---|---|---|
| GB | 152799 | 10/1920 |
| GB | 200704 A | 7/1923 |
| JP | UM S61-179341 U | 8/1986 |

(Continued)

*Primary Examiner* — Marguerite McMahon
*Assistant Examiner* — Tea Holbrook
(74) *Attorney, Agent, or Firm* — Weiner & Burt, P.C.; Irving M. Weiner; Pamela S. Burt

(57) ABSTRACT

The present invention relates to internal combustion engines and more particularly reciprocating piston engines utilizing Scotch yokes to translate rectilinear movement to rotary motion. In particular, the piston and/or pistons of the engine of the present invention can be placed in their topmost position for a period of time for the effective ignition and combustion of the air/fuel mixture for a given fuel charge, hence therefore providing an increased efficiency of the piston engine with a more efficient coupling between the piston and/or the power shaft driving the crank.

10 Claims, 7 Drawing Sheets

(56) References Cited

FOREIGN PATENT DOCUMENTS

| | | | | |
|---|---|---|---|---|
| JP | S61-179341 | U | | 11/1986 |
| JP | 01-216029 | | | 8/1989 |
| JP | 01216029 | A | * | 8/1989 |
| JP | H01-216029 | A | | 8/1989 |
| JP | 08-303254 | | | 11/1996 |
| JP | H08-303254 | A | | 11/1996 |
| JP | 2008-031908 | | | 2/2008 |
| JP | 2008-031908 | A | | 2/2008 |

* cited by examiner

COMBUSTION ENGINE

FIELD OF THE INVENTION

This invention relates to internal combustion engines and more particularly reciprocating piston engines utilising Scotch yokes to translate rectilinear movement to rotary motion.

BACKGROUND OF THE INVENTION

As the person skilled in the art will appreciate, the internal combustion engine has now been with us for many decades and has become a most familiar design wherein the reciprocating piston uses connecting rods to connect the piston to the crank pins of the crank shaft to translate linear reciprocating motion of the pistons to rotary motion of the crank shaft.

For the most part, a connecting rod is articulable at both ends where it attaches to the piston and crank pin. This piston is connected to the connecting rod by a wrist pin that passes through the piston and the connecting rod. For the most part, these kinds of designs for such internal combustion engines are known as slider crank engines. Nonetheless, time has proven that these types of internal combustion engines do have significant disadvantages and limitations.

There has been a push, particularly now that fossil fuels are becoming scarce and there is a greater community emphasis to protect the environment by way of exhaust coming from conventional internal combustion energy, to improve upon the conventional slider crank engine.

The Scotch yoke has been used in certain engine designs seeking to utilize cyclic dynamics over the slider crank engines.

For the most part, traditional Scotch yoke engines connect two horizontally opposed pistons by non-articulable connecting rods to a shuttle having a slot which accommodates the crank pin of a crank shaft. Guide services constrain the motion of the shuttle to a linear path and the crank pin slides within the slot as the crank shaft rotates through its range, converting the linear reciprocating piston movement to rotary crank shaft motion.

As the person skilled in the art will realise, the slot within the shuttle must be at least as wide as the crank pin diameter and at least as long as the diameter of the crank pin travel.

Further, as the piston rod is part of a piston plate or the like which is restricted to linear reciprocated motion, any movement of the crank shaft will automatically see the piston extended or retracted away from any settable momentary position, including the sparking position.

A present trend in engine design is to increase engine rpm using the conventional piston rod with a Scotch yoke structure. The use of convention scotch yokes is not always possible for the most part as the piston stroke is short and the time available for drawing air into the combustion chamber is very short. This causes combustion at less than the ideal 15 to 1 air/fuel ration for the fuel which in turn, leaves unburnt fuel to be exhausted as pollutants into the atmosphere.

With the exhausted unburnt fuel goes wasted energy which should have been converted to power to drive the piston.

What effectively is happening in both currently available slider crank engines as well as Scotch yoke base designs is that there is inefficient coupling between the piston rod and the crank shaft, and to date, to overcome this problem all people have ever done is to try to counteract the problem by including additional expensive intake valves placed into each cylinder to facilitate the additional air intake that has resulted from incomplete combustion of the air/fuel mixture.

Hence, one of the best ways to surmount the inefficiency in piston rod/crank shaft coupling is to create a mechanism whereby a piston rod would be in its fully extended position for a moment of time rather than a point of time, wherein the entire force of the piston would be in complete perpendicular positioning in its upper most position in the firing chamber to then provide an ignition which guarantees the effective combustion of the air/fuel mixture.

It is therefore an object of the present invention to overcome at least some of the aforementioned problems or to provide the public with a useful alternative.

It is a further object of this invention to provide an internal combustion engine based on the principles of using a Scotch yoke configuration, wherein the piston and/or pistons can be placed in their topmost position for a period of time for the effective ignition and combustion of the air/fuel mixture for a given fuel charge, hence therefore providing arguably an increased efficiency of the piston engine with a more efficient coupling between the piston and/or the power shaft driving the crank.

Further objects and advantages of this invention will become apparent from a complete reading of the following specification.

SUMMARY OF THE INVENTION

Accordingly, in one form of the invention, although this need not be the only nor indeed the broadest form of the invention, there is provided an assembly for translating substantially rectilinear motion of a linearly moveable member that is moveable between a top dead centre and a bottom dead centre position, to rotary motion of a rotatable shaft, or vice versa, said assembly characterised by: a yoke structure associated with the linearly moveable member, said yoke structure including an inner surface, the rotatable shaft including a wheel member rotatable about an axis disposed a spaced apart distance from an axis of rotation of said rotatable shaft, such that an outer peripheral edge of said rotatable wheel member is adapted for substantially frictionless engagement with the yoke structure inner surface, said engagement being crank-related through at least a first range of shaft rotation angles during which extending or retracting motion of the linearly moveable member translates to rotational motion of the shaft, and cam-related through at least a second range of shaft rotation angles during which the position of the linearly moveable member dwells in an extended or retracted position until the shaft is rotated beyond said at least second range of shaft rotation angles; and wherein said engagement is cam-related at least at the commencement of each shaft revolution to cause a dwell of said linearly moveable member at top dead centre.

Preferably said yoke structure includes a hollowed out portion, said inner surface being an inner peripheral edge of the hollowed out portion.

In preference said inner peripheral edge is dimensioned such that between 45 and 360 degree rotation of the shaft, the assembly is in a crank mode whereby rotation of the shaft and leverage means translates the rectilinear motion of the extending and retracting member into rotating motion against the shaft.

Preferably said inner peripheral edge is dimensioned such that between 0 and 45 degree rotation of the shaft, the assembly is in a cam mode whereby the position of the moveable member dwells at top dead centre until the shaft is rotated beyond 45 degrees.

In preference said inner peripheral edge dimension includes at least one shoulder which deviates from an end of two parallel linear edges, the shoulder having an inner peripheral edge which functions as a cam during said cam mode.

Preferably said wheel member is adapted to contact the inner peripheral edge at two contact points substantially throughout each revolution of the shaft such that the wheel member is rotatably guided by the inner peripheral edge.

In a further form of the invention there is proposed an internal combustion engine for translating substantially rectilinear motion of an extending and retracting piston that is moveable between top dead centre and bottom dead centre, into rotatable motion of a crank shaft, said engine characterised by:

at least one piston having associated therewith a yoke structure having an inner surface, said crank shaft including a wheel member rotatable about an axis disposed a spaced apart distance from an axis of rotation of said rotatable shaft, such that an outer peripheral edge of said wheel member is adapted for substantially frictionless engagement with the yoke structure inner surface, said engagement being crank-related through at least a first range of crank rotation angles during which extending or retracting motion of the piston translates to rotational motion of the shaft, and cam-related through at least a second range of crank rotation angles during which the position of the piston dwells in an extended or retracted position until the shaft is rotated beyond said at least second range of crank angles; and wherein said engagement is cam-related at least at the commencement of each shaft revolution to cause a dwell of said piston at top dead centre.

Preferably the engine is configured such that when the wheel member engages a shoulder along the length of the inner peripheral edge, and the wheel member goes into the mode of a cam, at the shoulder engagement, the piston is in and remains in its topmost position, wherein said piston will remain in said topmost position until the wheel member has been rotatably guided beyond the shoulder of the inner peripheral edge.

Advantageously the inner peripheral edge introduces the shoulder along its length such that the rotation of the wheel member about the edge is such that the wheel member remains upon the shoulder, and thereby in the cam mode for a period of guidance which sees crank shaft rotation between 0° to 45° when the piston is in the topmost extended position.

Preferably when the piston is in the topmost position at the moment of ignition of the air/fuel mixture, the crank shaft continues a rotation between 0° to 45° without any of such rotary movement being translated on rectilinear motion of the piston.

An advantage of such an arrangement is that the use of introducing a shouldered length along the inner peripheral edge of the Scotch yoke configuration means that the continual rectilinear motion between the piston and the crank shaft which sees the linear motion being transformed into rotatory motion is momentarily interrupted in that once the wheel member engages the shoulder, the wheel member begins a functionality change from being a crank to a cam.

As the wheel member is not a cam when in contact with the shoulder, there is no change in the positioning of the piston from its topmost position. Advantageously as the piston rod and crank shaft are effectively decoupled by the switching or the change of mode of the wheel member from the crank to the cam, means that the piston can have a certain dwell time in remaining in the topmost position which causes complete combustion of the hydrocarbon fuel.

Advantageously, there is no unburnt fuel to be exhausted as pollutants into the atmosphere.

Also advantageously, as there is no exhausted unburnt fuel, there is no wasted energy, and in fact, as the fuel is ignited for the most part in its entirety, this is converted to additional power to drive the piston and so forth onto the crank shaft.

Advantageously, this unique re-designing of the Scotch yoke to introduce the shoulder on the Scotch yoke allows the wheel member to change from a crank into a cam to disengage the piston and crank shaft. This de-coupling creates a fixed length moment of time for the piston to be in the upmost position so that the igniting of the fuel will see the entire force of the piston being applied because all the fuel is burnt and this translates to a higher torque power at the output shaft to the crank shaft once the wheel member again becomes directly engaged as a crank.

As the person skilled in the art will appreciate, this arrangement applies more of the piston's power to the output shaft and over a greater part of the power stroke than is possible with a conventional coupling between piston rod and crank shaft.

Effectively, through this unique feature, one can design the inner peripheral edge of the yoke structure such that the rotatable movement of the wheel member about the inner peripheral edge can be such that for certain angles of degrees of rotation of the crank shaft rotation can see no movement whatsoever of the piston travel either between extended or retracted positions.

The inner peripheral edge introduces the shoulder along its length such that the rotation of the wheel member about the edge is such that the wheel member remains upon the shoulder, and thereby in the cam mode for a period of guidance which sees crank shaft rotation between 0° to 45° when the piston is in the topmost extended position.

Consequently, when the piston is in the topmost position at the moment of ignition of the air/fuel mixture, the crank shaft can continue a rotation between 0° to 45° without any of such rotary movement being translated on rectilinear motion of the piston.

Preferably the rotation of Cam (pressure) and Crank (release) in preference follows these tabled results below in table 1;

TABLE 1

| | |
|---|---|
| Crank rotation 0°-45° | Piston dwell (piston dwell can be altered to any crank degree - before/after TDC - top dead centre).<br>Pressure release angle can be modified to suit application. |
| Crank rotation 45°-135° | Piston pressure at its most effective to produce crank rotation. |
| Crank rotation 135°-180° | Piston reaches BDC (bottom dead centre) of stroke. |
| Crank rotation 180°-0° | Piston travels back to TDC as per scotch yoke movement. |
| Crank rotation 180°-0° | Piston travel can be modified to have a BDC dwell equivalent - to piston travelling down (0°-45°) or other movement. |

Dwell allows all fuel to be burnt efficiently and effectively (lowering emissions) releasing all the pressure at the most effective crank angle (Torque). Frictionless design gains hp and reliability. Yoke design can be altered to any angle of movement before or after TDC.

The contrary is the case in that through the use of the wheel member there is almost a decoupling effect between the crank shaft and the piston, thereby giving the piston once in the uppermost position, a certain dwelling time which will see the effective combustion of the fuel with the air mixture.

BRIEF DESCRIPTION OF THE DRAWING FIGURES

The accompanying drawings, which are incorporated in and constitute a part of this specification, illustrate several implementations of the invention and, together with the description, serve to explain the advantages and principles of the invention. In the drawings:

FIG. 1 illustrates a perspective view of one embodiment of this invention wherein a four cylinder internal combustion engine is provided for;

Figure 2:
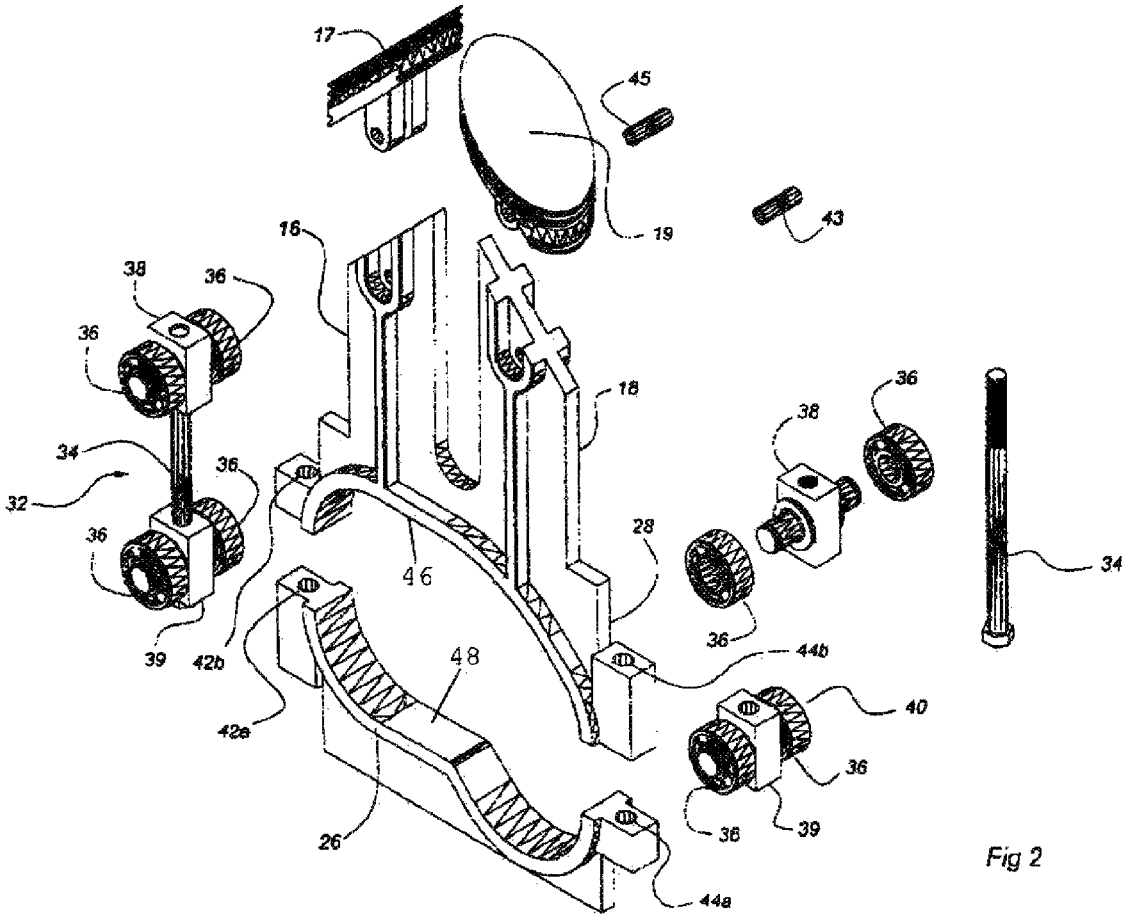
FIG. 2 illustrates an exploded view of FIG. 1 in an exploded configuration showing one example of the Scotch yoke with two pistons attached thereto.
Figure 3:
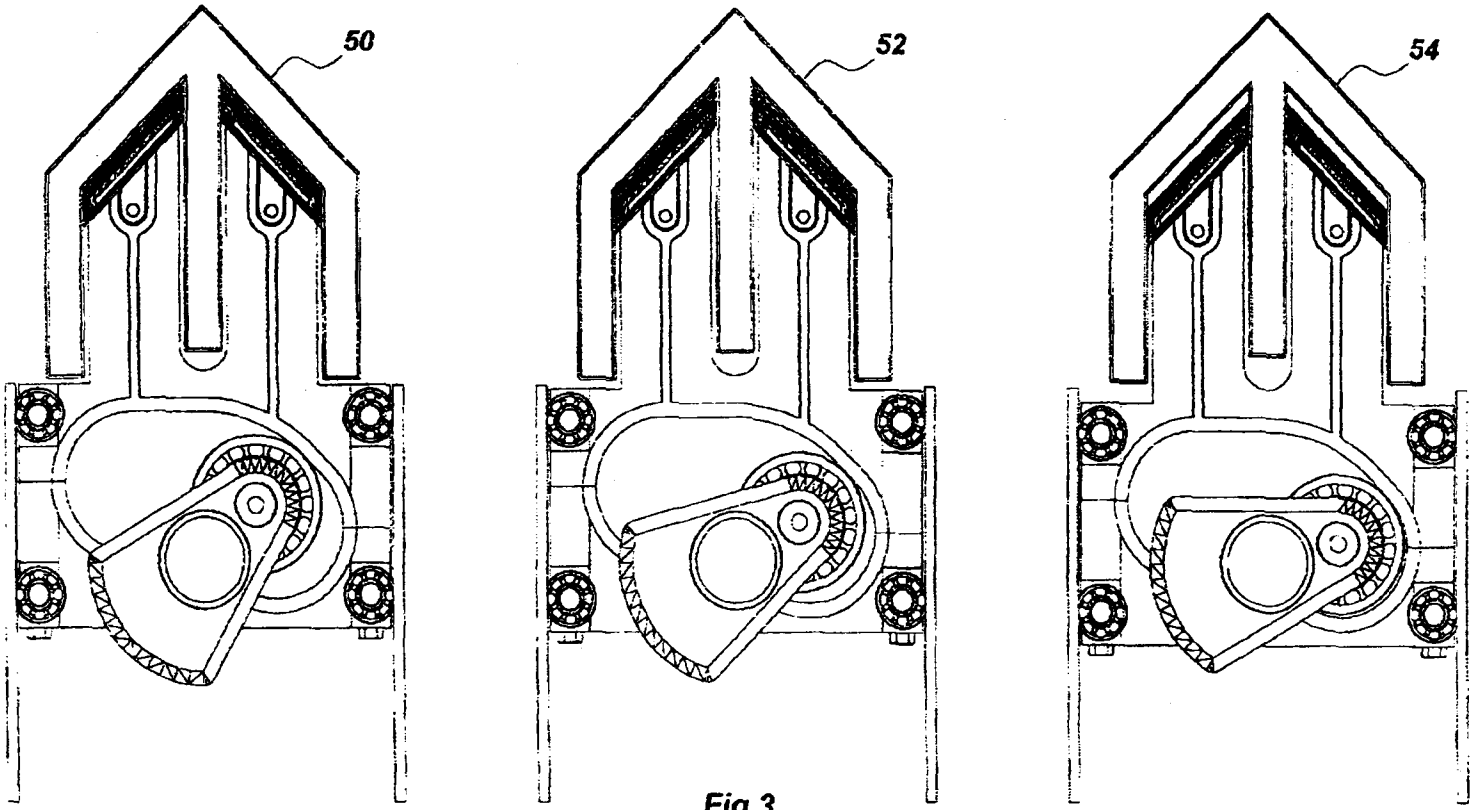
FIG. 3 illustrates a schematic representation of the relevant translation of movement between the crank shaft and the piston within the respective cylinders over a period of rotation.
Figure 4A:
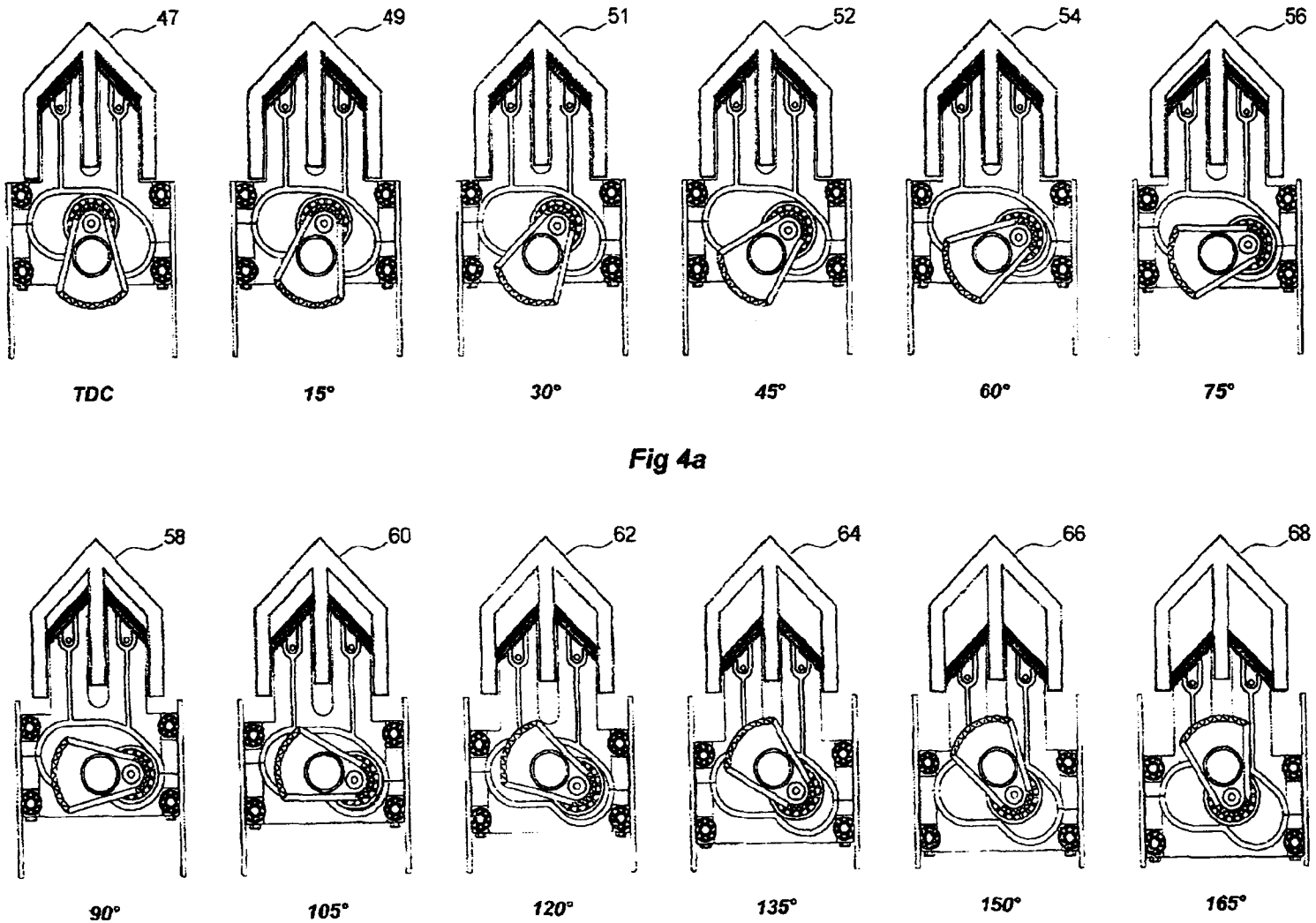
Figure 4B:
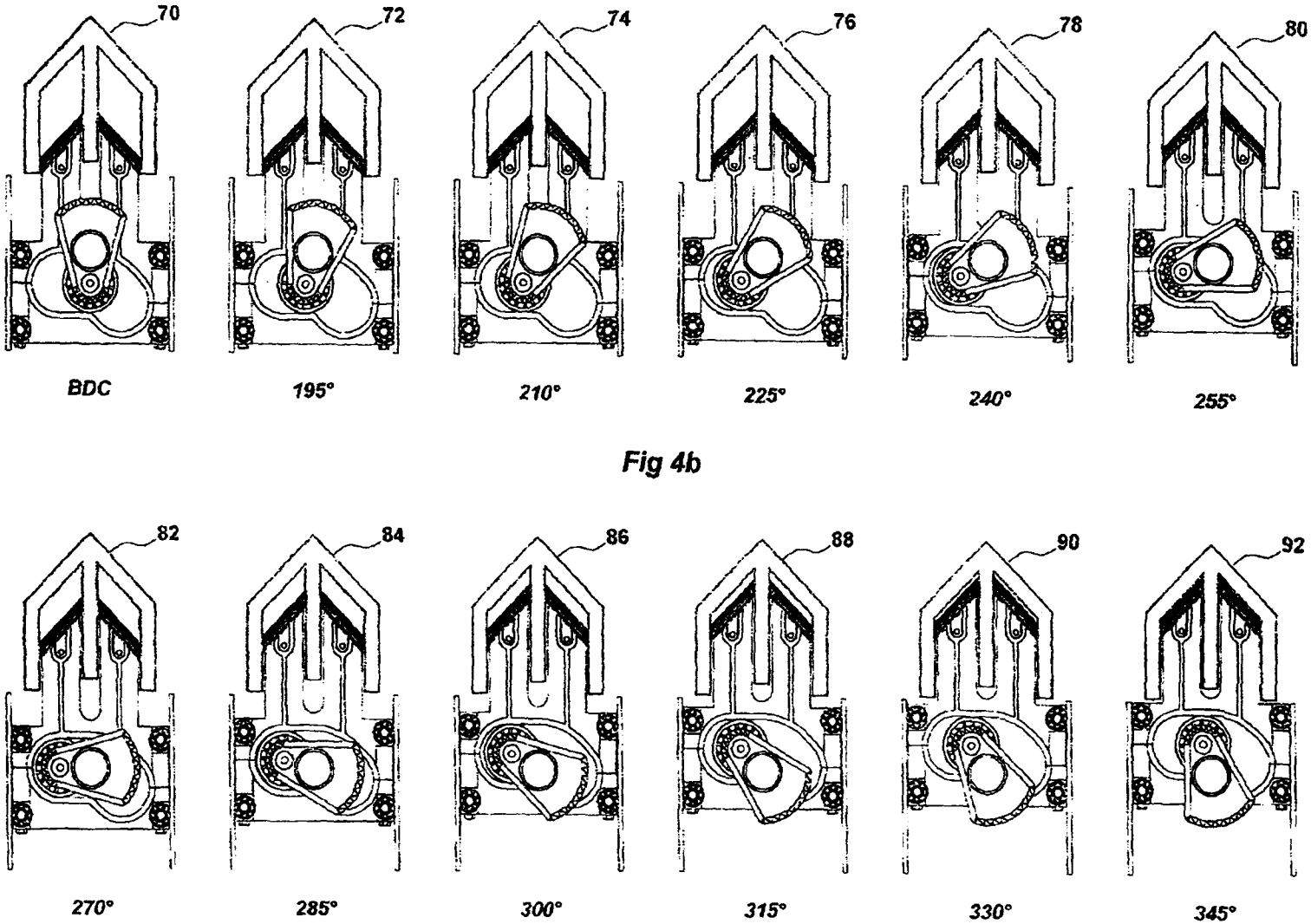
Figure 5:
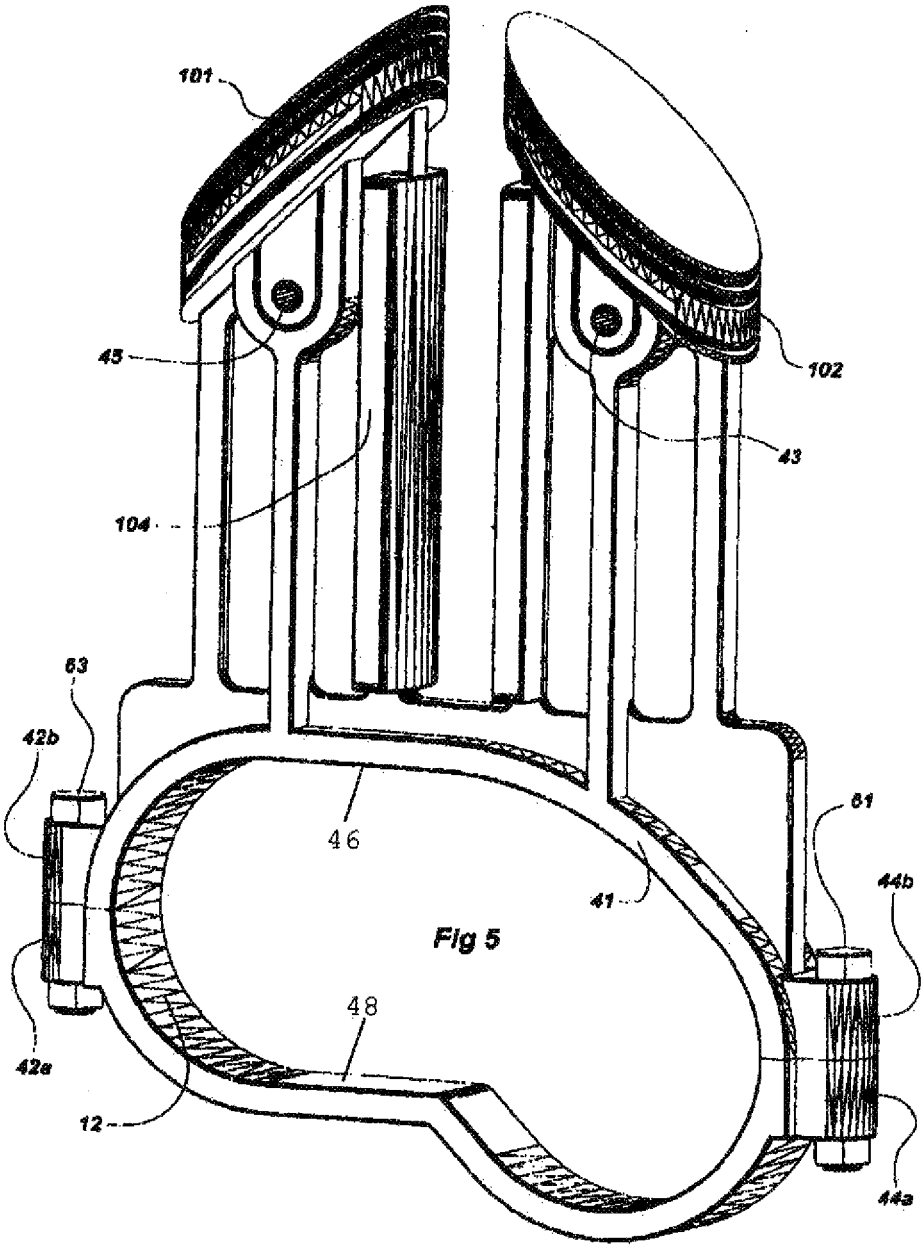
Figure 6:
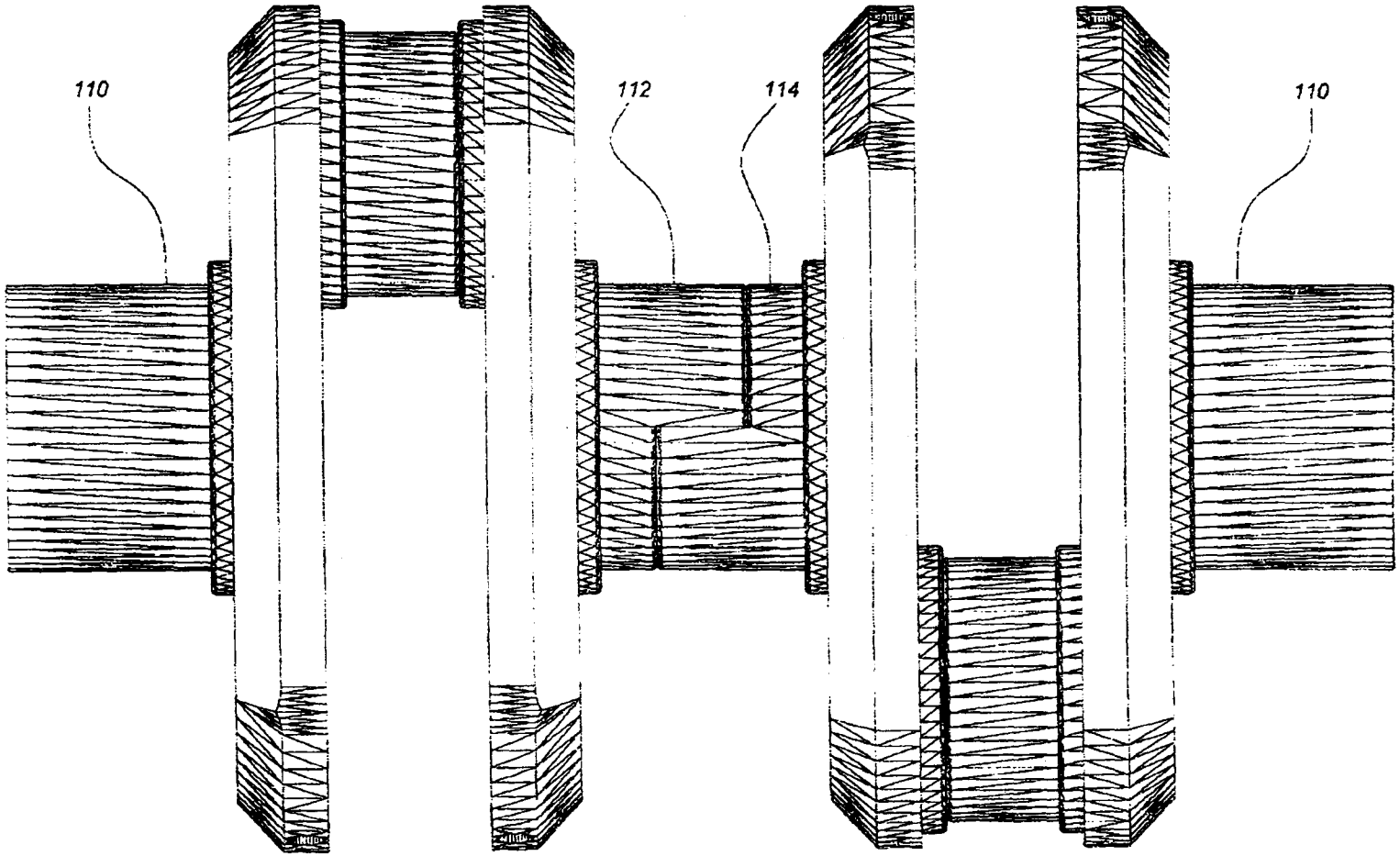

FIGS. 4*a*-4*b* illustrate a further expansion of the representation shown in FIG. 3, wherein the complete crank shaft rotation between 0° to 360° is acknowledged with respect to the translated piston travel for that corresponding rotation;

FIG. 5 illustrates a similar embodiment in the unexpanded configuration to that shown in FIG. 2 with some additional features and description included; and FIG. 6 introduces a further embodiment of the invention wherein the crank shaft is constructed with modulated segments.

DETAILED DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the embodiments and the following description to refer to the same and like parts.

Referring to the drawings now in greater detail, wherein the internal combustion engine 10 would include as part of its arrangement a Scotch yoke structure 12 which is divided into top portion 28 and a bottom portion 26.

The Scotch yoke structure 12 includes an inner peripheral edge 13 which provides a guide to which the wheel member 29 is adapted to rotate thereabouts.

Figure 1:
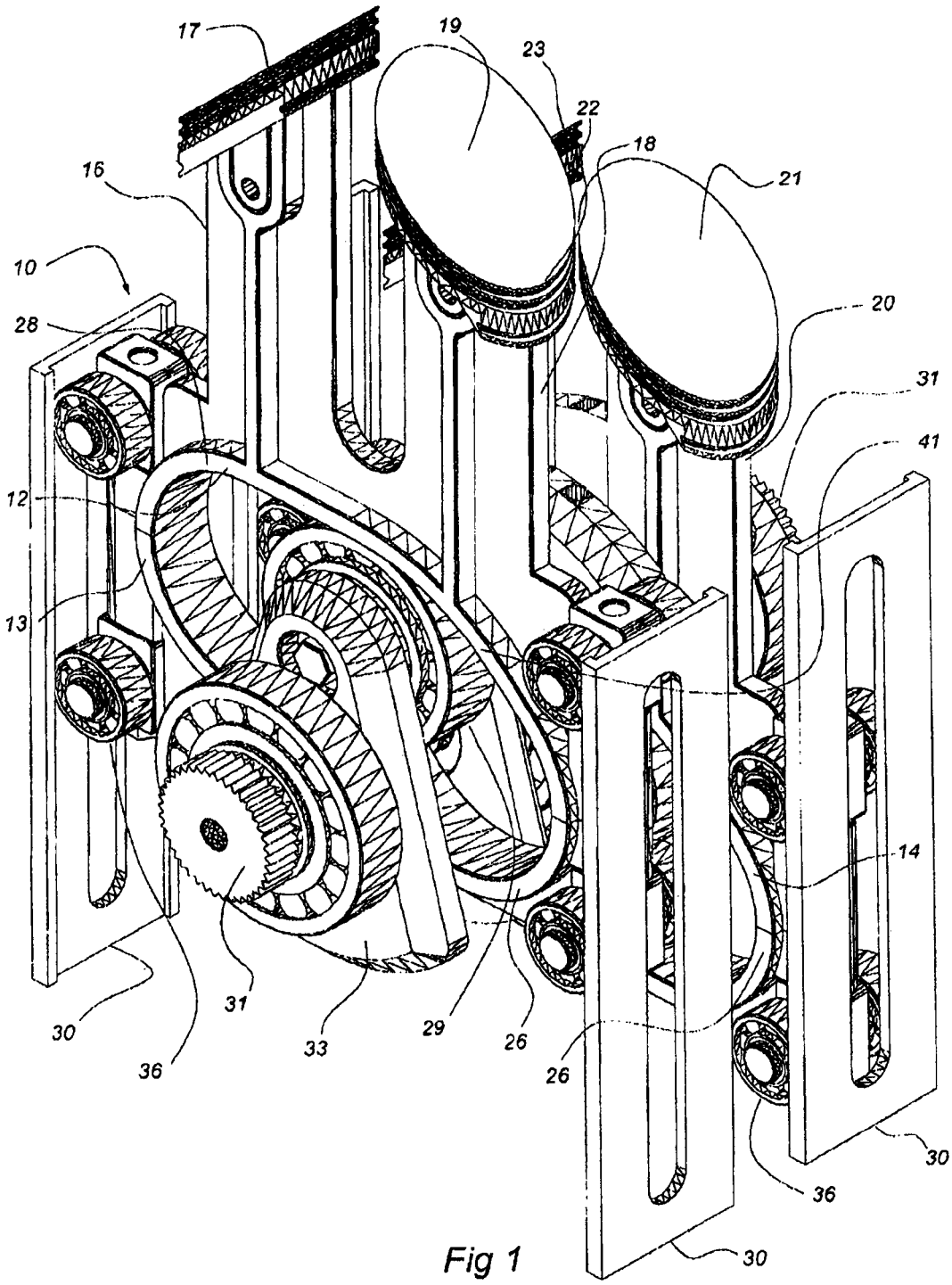

In FIG. 1 a four piston, or more precisely, four cylinder internal combustion engine is illustrated.

For simplicity, the actual cylinder chambers to which the respective pistons 16, 18, 20 and 22 would extend and retract therein, have been removed so that the important and inventive aspects of this invention can be discussed more clearly.

Pistons pairs 16 and 18, and 20 and 22, form part of the overall scotch yoke structures 12. Therefore, when combustion occurs inside a cylinder chamber the pistons and therefore the scotch yoke structure 12 move along a rectilinear path and such movement translates into rotational motion against the crank shaft via a crank arm 33 which extends alongside the scotch yoke structure 12. In the embodiment shown, the crank shaft includes at its ends two discs 31 which are meshed on their outside surface to facilitate connection to a housing or other engine component (not shown).

Guide members 30 have been included and through the arrangement of the ball bearing configuration shown generally as 32 in FIG. 2, includes a series of rollers 36 which are rotatably supported in respective housings 38, 39 and joined together by bolt 34.

The guide 30 along with the bearing or roller arrangement 32 contributes for the most part to a frictionless extension of the respective pistons from their extended and retracted positions within a cylinder chamber.

As best seen in FIG. 2, the piston heads 17 and 19 are able to be easily removed through the use of the fastening pins 43 and 45.

Advantageously, this means that when the cylinder head or piston heads need maintenance or replacing, the job is straight forward as the respective heads can be disengaged from the upper structure of the Scotch yoke.

As the bearing or roller arrangement 32 is able to be guided through the roller mechanism up and down guide 30, means that there is no actual frictional engagement between the cylinder or piston heads as they make their way up and down the cylinder chamber.

As possibly best seen in FIG. 5, the use of the rings and the oil scraper 102 means that no unnecessary heat or elevated temperature conditions are created as the piston makes its way up and down inside the cylinder chamber as the wheel member moves around the inner peripheral edge of the Scotch yoke structure as the substantially rectilinear motion of the moving pistons are translated to a rotary motion up against the crank shaft.

As best seen in FIGS. 2 and 5, the upper and bottom portions of the Scotch yoke structure can be fastened together at the respective points 42*a*, 42*b* and 44*a*, 44*b* through respective bolts 61 and 63.

Removable inner slides 104 can also be included as part of the arrangement, again reinforcing with the guided system support for the piston in complete frictionless airtight extension and retraction inside the cylinder chamber as the piston is moved up and down through the effects of the wheel member rotatably moving about the inner peripheral edge of the Scotch yoke structure 12.

The preferred embodiment presents the piston with an inclined surface that provides for an ellipse surface area engagement of the piston head with the fuel to be ignited. The ellipse surface provides greater surface area. While it is advantageous to use such a design it is not essential to the invention.

In consideration of FIGS. 1-5, a person skilled in the art should 15 appreciate how a system employed for this internal combustion engine is working, which for its main purpose is to see that each of the respective cylinders would have a piston in its uppermost position at the point of firing for a period of time rather than simply a point of time so that piston can remain at that uppermost position so that all the hydrocarbon fuel in the air/fuel intake is burnt rather than leaving any unburnt fuel to be exhausted.

This ability to create a dwelling time for the piston to remain in the uppermost position inside the cylinder chamber is achieved by the fact that the wheel member 29 rotates up against a first linear surface 46 which extends into a shoulder 41 of the inner peripheral edge 13 of the Scotch yoke structure 12 and as this happens the functionality of the wheel member changes from being in a crank mode to a cam mode.

Hence, as best seen in FIG. 3, while the crank shaft continues its rotation between 0°-45°, the pistons themselves have not moved from their uppermost position which means that as the piston is allowed to dwell in its uppermost position for a moment of time, despite the fact the crank shaft has continued its rotation, means that this additional time allows for the complete burning of the hydrocarbon fuel.

Advantageously, peak pressure at the optimum crank angle is achieved not for a point of time but in fact a period of time.

As the wheel member 29 continues its way around the inner peripheral edge 13 of the Scotch yoke 12, the shoulder 41 has a defined length which holds the wheel member in the cam mode until it leaves shoulder 41 to again rejoin conventional configuration of the Scotch yoke and whereby the movement of the wheel member 29 away from the shouldered length 41 and to a second linear surface 48 of the inner peripheral edge 13 of the Scotch yoke structure 12, returns the functionality of the wheel member 29 back to a crank, such that any subsequent rotation of the crank shaft and vice versa any rectilinear motion of the piston sees a direct translation between such motion from the piston to the crank shaft and vice versa.

In the conventional Scotch yoke arrangement, though it is difficult to apply to such designs readily to those illustrated in FIGS. 1 to 5, a person skilled in the art can appreciate that for the most part the wheel member is constrained very carefully within a guided rim of continuous rotation within the Scotch yoke structure.

Any rotatable movement of the wheel member simply is translated to motion upon the crank shaft.

Hence, the piston never stays stationary so long as the crank shaft is in rotation and so there is no opportunity for the piston to remain in its upmost position longer than simply a point of time rather than a period of time.

However, advantageously in this invention, the introduction of the shoulder about the peripheral edge of the Scotch yoke has provided a means in which the piston and the crank shaft effectively become decoupled through certain degrees of rotation of the crank shaft.

Advantageously, it is up to the designer of the engine to decide where and when the decoupling effect between the piston and the crank shaft takes place and for how long.

Effectively such an engine provided by this invention means that designers can now decide their own degree of crank angle and cylinder pressure to achieve optimum flame burning of the hydrocarbon fuel.

While this is the essential aspect of the invention, various advantageous extensions can be included thereupon, not the least having two cylinders connected as a single piece to the Scotch yoke structure.

As the person skilled in the art can appreciate, one cylinder can be at the point of ignition while the adjacent piston can be in a position for intake of air, and so forth.

Advantageously, by being able to place two pistons conveniently upon the Scotch yoke structure means that the size of the internal combustion engine can be greatly reduced.

As also introduced above, the introduction of the guided mechanism through guides 30, along with rollers 32 means that respective pistons are held in place without any friction or contact with the sides of the cylinder chamber, thereby again keeping the temperature of the engine substantially lower.

FIGS. 3 and 4 show schematically the relative distance travelled of the piston relative to the crank shaft rotation with the crank shaft rotation starting a 0° at 47, then working through 47, 49, 51, 52, 54, 56, 58, 60, 62, 64, 66, 68, 70, 72, 74, 76, 78, 80, 82, 84, 86, 88, 90 and 92 when crank shaft rotation extends to 345°.

During the crank shaft rotation as listed, the piston travels a certain length, however the piston will only travel once the wheel member is in crank mode rather than the cam mode which functionality is provided for once the wheel member begins to engage the shoulder upon the peripheral edge of the Scotch yoke structure.

FIG. 6 provides for further embodiment of this invention wherein the crank shaft 110 can be divided into modular section 112 and 114 and so forth to build up additional Scotch yoke structures and thereby the cylinder capacity of the engine as required.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. An assembly for translating substantially linear motion of a linearly moveable member between a top dead centre and a bottom dead centre position to rotary motion of a rotatable shaft, said assembly characterised by:

a crank arm associated and rotatable with said rotatable shaft, said crank arm including a rotatable wheel having an outer peripheral edge and an axis of rotation;

a yoke structure associated with the linearly moveable member and moveable therewith, said yoke structure including an inner peripheral edge along which said wheel is caused to roll during rotation of the crank arm, the inner peripheral edge including a first linear surface that extends substantially perpendicularly to a direction of travel of the linearly moveable member and which is encountered by said wheel from at least the commencement of each shaft revolution when the linearly moveable member is at top dead centre, wherein during said encounter with the first linear surface a contact point between the yoke first linear surface and the wheel outer edge is along an axis that extends parallel to the direction of travel of the linearly moveable member and through the wheel's axis of rotation, said inner peripheral edge further including a shoulder that deviates outwardly and in a downstroke direction from the first linear surface and which has an inner surface dimensioned to cause said contact point to shift outwardly along the outer peripheral edge of the wheel and thereby outwardly from said axis extending parallel to the direction of travel and through the wheel's axis of rotation, said shoulder being positioned such that the wheel encounters the shoulder during said downstroke, after encountering the first linear surface, at approximately 45 degrees.

2. The assembly as characterised in claim 1 wherein said outer peripheral edge and yoke structure inner edge are dimensioned such that engagement there between is crank-related when the wheel is encountering the first linear surface, during which the shaft translates the linear motion of the linearly moveable member into rotating motion against the shaft, and is cam-related when the wheel at least commences its encounter with the shoulder, during which the linearly moveable member dwells.

3. The assembly as characterised in claim 2 wherein dimensions are such that when the wheel commences its encounter with the shoulder and causes dwell of the linearly moveable member, the linearly moveable member is at approximately top dead centre.

4. The assembly as characterised in claim 1 wherein said shoulder deviates from an end of the first and a second linear surface, the second linear surface extending parallel to the first linear surface and separated by a distance larger than a diameter of said wheel to enable said wheel to rotate when travelling between the first and second linear surfaces.

5. The assembly as characterised in claim 4, wherein spaced surfaces of said shoulder includes a spaced apart dimension to corresponding with that between the first and second linear surfaces to enable said wheel to travel in and then out of said shoulder.

6. The assembly as characterised in claim 4, wherein the wheel encounters the second linear surface, after encountering the shoulder, at approximately 180 degrees shaft rotation.

7. The assembly as characterised in claim 1 wherein said linearly moveable member includes a guide means to facilitate said linear movement thereof.

8. The assembly as characterised in claim 1 wherein said assembly is an internal combustion engine.

9. The assembly as characterised in claim 1 wherein said linearly moveable member is at least one piston.

10. The assembly as characterised in claim 1 wherein said rotatable shaft is a crank shaft.

* * * * *